US007936138B2

(12) United States Patent
Katsuyama et al.

(10) Patent No.: US 7,936,138 B2
(45) Date of Patent: May 3, 2011

(54) MOTOR CONTROLLER FOR RADIO CONTROL

(75) Inventors: Kazuo Katsuyama, Mobara (JP); Hideo Kitazawa, Mobara (JP); Takatoshi Morita, Mobara (JP)

(73) Assignee: FUTABA Corporation, Mobara-shi (JP)

( * ) Notice: Subject to any disclaimer, the term of this patent is extended or adjusted under 35 U.S.C. 154(b) by 284 days.

(21) Appl. No.: 12/336,932

(22) Filed: Dec. 17, 2008

(65) Prior Publication Data

US 2009/0160375 A1 Jun. 25, 2009

(30) Foreign Application Priority Data

Dec. 25, 2007 (JP) ..... 2007-332944

(51) Int. Cl.
*G05D 1/02* (2006.01)

(52) U.S. Cl. ..... 318/16; 318/9

(58) Field of Classification Search ..... 318/9, 16, 318/461, 364, 370, 280, 283
See application file for complete search history.

(56) References Cited

U.S. PATENT DOCUMENTS 4,334,221 A * 6/1982 Rosenhagen et al. ..... 463/6
4,938,483 A * 7/1990 Yavetz ..... 463/5
6,247,994 B1 * 6/2001 DeAngelis et al. ..... 446/454
6,656,012 B1 * 12/2003 DeAngelis et al. ..... 446/454

* cited by examiner

*Primary Examiner* — Rina I Duda
(74) *Attorney, Agent, or Firm* — Brundidge & Stanger, P.C.

(57) ABSTRACT

Provided is a motor controller for controlling a motor installed at an object such as an electric car operated using a transmitter. A manipulation of a manipulation tool of the transmitter is allocated for brake and reverse modes. A specific value of brake power contained in a signal demodulated by a receiver is stored in a memory unit as a changeover reference value, and a changeover determining unit compares the changeover reference value with the brake power. If the brake power is greater than the changeover reference value, the changeover determining unit transmits a changeover signal to a control unit, and if the manipulation tool is manipulated to a neutral point after the control unit receives the changeover signal, the control unit changes the state of the manipulation tool from brake mode to reverse mode. The changeover reference value can be changed by an operator using an external device.

3 Claims, 5 Drawing Sheets

MOTOR CONTROLLER FOR RADIO CONTROL

CROSS-REFERENCE TO RELATED PATENT APPLICATION

This U.S. non-provisional patent application claims priority under 35 U.S.C. §119 of Japanese Patent Application No. 2007-332944, filed on Dec. 25, 2007, in the Japanese Patent Office, the entire contents of which are hereby incorporated by reference.

BACKGROUND OF THE INVENTION

1. Field of the Invention

The present invention relates to a motor controller for controlling the rotation direction and rotation speed of a motor of a control target such as an electric car operated by a radio control device, and more particularly, to a motor controller for radio control, which includes a changeover unit for changing the manipulation state of a manipulation tool from a braking state to a reverse moving state.

2. Description of the Prior Art

A conventional motor controller is used in a control target such as an electric car operated using a radio control device to control the rotation direction and rotation speed of a motor installed in the control target for forward moving, reverse moving, and/or braking of the control target.

There are various motor controllers, such as a motor controller installed in a model airplane for controlling only the forward moving of the model airplane, and a motor controller installed in an electric car for controlling the forward moving, reverse moving, and/or braking of the electric car.

Among such conventional motor controllers, there is a commercially available motor controller that is configured to be installed in an electric car for controlling the forward moving, reverse moving, and/or braking of the electric car. The commercially available motor controller controls the forward moving, reverse moving, and braking of the control target by using a manipulation tool installed at a transmitter used to manipulate the control target. In the commercially available motor controller, a manipulation state for moving a control target forward is referred to as a forward mode, a manipulation state for moving the control target in reverse is referred to as a reverse mode, and a manipulation state for braking the control target is referred to as a brake mode.

Specifically, the manipulation tool may be a rod-shaped stick lever or a gun-trigger-shaped lever, which can be manipulated in two directions from a neutral point. The manipulation tool returns to the neutral point automatically after being manipulated. One direction from the neutral point is allocated for a manipulation state (mode) such as a forward mode, and the other direction from the neutral point is allocated for another manipulation state such as a reverse mode. The neutral point is not allocated for any mode of the motor controller.

Although there is a motor controller having three modes as manipulation states, the motor controller allocates one direction of a manipulation tool for a forward mode and the other direction of the manipulation tool for one of a brake mode and a reverse mode.

Therefore, when the manipulation tool is moved in the other direction, several methods are practically used for selecting one of the brake mode and the reverse mode.

According to one of such practical methods, a changeover switch is used to select the brake mode or the reverse mode. Alternatively, in a motor controller not using a changeover switch, the mode allocation of a manipulation tool is changed, for example, from forward and brake modes to forward and reverse modes in response to an operator's predetermined manipulation of the manipulation tool.

Next, with reference to FIG. 5, an explanation will be given on a motor controller that changes manipulation mode when a manipulation tool is manipulated in a predetermined manner. FIG. 5 illustrates an exemplary conventional motor controller. A control-data signal is output according to the manipulation amount of a manipulation tool (not shown) installed in a transmitter (not shown) and is transmitted to a receiver 11 where the control-data signal is demodulated. Then, based on the demodulated signal output from the receiver 11, a motor controller 30 controls the operation of a motor 12 installed in a control target, such as the rotation direction and rotation speed of the motor 12.

Specifically, when a rotation direction of the motor 12 for moving the control target forward is referred to as a forward direction and a rotation direction of the motor 12 for moving the control target in reverse is referred to as a reverse direction, the operation of the motor 12 is controlled as follows. When the manipulation tool is manipulated in one direction, the motor 12 is rotated in the forward direction, and when the manipulation tool is manipulated in the other direction, the motor 12 is braked or rotated in the reverse direction. At this time, the speed or brake power of the motor 12 is increased or decreased according to the manipulation amount of the manipulation tool so that the forward moving, reverse moving, or braking of the control target can be controlled. Here, the braking of the control target means a braking action against a forward movement of the control target.

Next, the structure of the motor controller 30 will be explained in detail. A signal demodulated by the receiver 11 is input to a control unit 31 through a buffer circuit 1. The control unit 31 converts the demodulated signal to a control signal by referring to a set value stored in a memory unit 32 and outputs the control signal to a drive circuit 3. The drive circuit 3 outputs a driving signal to the motor 12 based on the control signal for controlling the operation of the motor 12.

A current detecting circuit 4 detects the current flowing through the drive circuit 3 and transmits a detected current value to the control unit 31. The control unit 31 compares a maximum current value stored in the memory unit 32 with the current value received from the current detecting circuit 4 so as to control the current flowing through the drive circuit 3.

A manipulation unit 6 is a switch used to change the control state of the motor controller 30 for controlling the motor 12, and the setup state of the memory unit 32 for changing the set value stored in the memory unit 32.

In the motor controller 30, set values stored in the memory unit 32 can be changed. Examples of changeable set values include a maximum current value of the drive circuit 3 and data about a high point of the manipulation tool at which the output power of the motor 12 is maximal. Changing of a set value is carried out by reading a set value from an external device 34 through a serial communication circuit 33 and storing the read set value in the memory unit 32 through the control unit 31 (refer to Patent Document 1).

An explanation will now be given on changing of a mode indicating a manipulation state. Generally, in a motor controller, manipulation of a manipulation tool in one direction is allocated for a forward mode, and manipulation of the manipulation tool in the other direction is allocated for a brake mode. When the manipulation tool is returned to a neutral point after the manipulation tool is manipulated in the other direction to brake a control target, a control unit changes the mode to allocate the manipulation of the manipulation tool in the other direction to a reverse mode.

Furthermore, in the motor controller, if the manipulation tool is manipulated in one direction from the neutral point after the other direction is allocated for the reverse mode, the control unit changes the mode to allocate the other direction of the manipulation tool for the brake mode.

However, in the motor controller, when the manipulation tool is returned to the neutral point after the control target is braked, the mode is changed from the brake mode to the reverse mode. Therefore, an operator cannot brake the control target finely. That is, fine brake manipulation (so-called pumping brake manipulation) cannot be done for intermittently braking the control target.

Furthermore, mode changing can be performed although an operator does not intend. In this case, the control target may behave abnormally, and thus, the control target may be broken.

[Patent Document 1] Japanese Unexamined Patent Application Publication No. H6-312065

SUMMARY OF THE INVENTION

An object of the present invention is to provide a motor controller for radio control, which allows intermittent braking, prevents an unexpected mode change, and provides a simple manipulation method for changing a mode without confusing an operator.

According to an aspect of the present invention, there is provided a motor controller for radio control, the motor controller being installed in a control target to be remotely controlled so as to control forward-moving, reverse-moving, and braking of the control target by controlling a rotation direction and a rotation speed of a motor installed in the control target based on a signal demodulated, by a receiver, from a control-data signal transmitted from a transmitter to the receiver in response to a manipulation amount of a manipulation tool of the transmitter, the manipulation tool being configured to be manipulated in at least two directions from a neutral point such that when the manipulation tool is manipulated in one direction, the control target is moved forward, and when the manipulation tool is manipulated in the other direction, the control target is braked or moved in reverse, the motor controller including a changeover unit configured to change a manipulation state of the manipulation tool from a brake mode to a reverse mode, wherein the changeover unit includes: a memory unit configured to store a specific value of a brake power contained in the signal demodulated by the receiver as a changeover reference value for changing the manipulation state of the manipulation tool from the brake mode to the reverse mode; a setup unit configured to change the changeover reference value; a changeover determining unit configured to compare the brake power with the changeover reference value so as to output a changeover signal when the brake power is equal to or higher than the changeover reference value; a control unit configured to change the manipulation state of the manipulation tool from the brake mode to the reverse mode when the manipulation tool is manipulated to the neutral point after the control unit receives the changeover signal.

In some embodiments, the setup unit may include a serial communication circuit connected to an external device for reading a changeover reference value set at the external device and replacing the changeover reference value stored in the memory unit with the read changeover reference value.

In other embodiments, the setup unit may include a switch installed at the motor controller for reading a changeover reference value set by the switch and replacing the changeover reference value stored in the memory unit with the read changeover reference value.

DETAILED DESCRIPTION OF THE PREFERRED EMBODIMENTS

Figure 1:
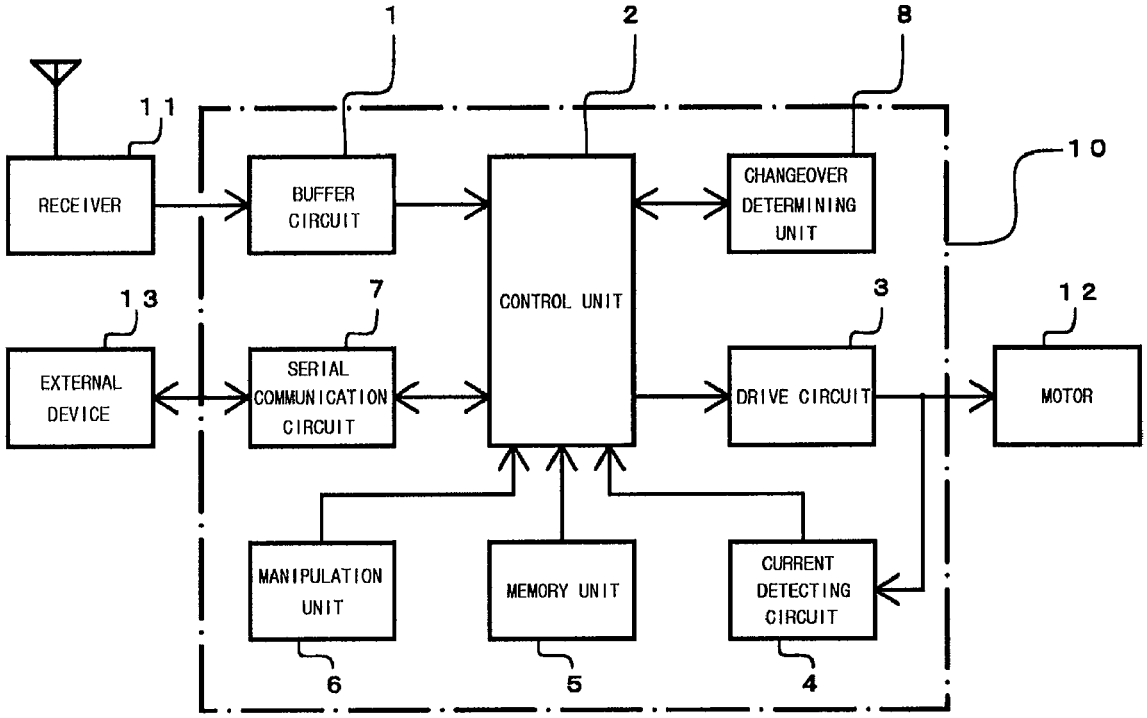
FIG. 1 is a block diagram illustrating a motor controller for radio control in accordance with an embodiment of the present invention.

A motor controller will be described hereinafter with reference to FIG. 1, FIG. 3, and FIG. 4. Elements of FIG. 1 having the same structures as the conventional elements illustrated in FIG. 5 will be denoted by the same reference numerals, and descriptions thereof will be omitted.

FIG. 1 is a block diagram illustrating a motor controller for radio control in accordance with an embodiment of the present invention.

Figure 3:
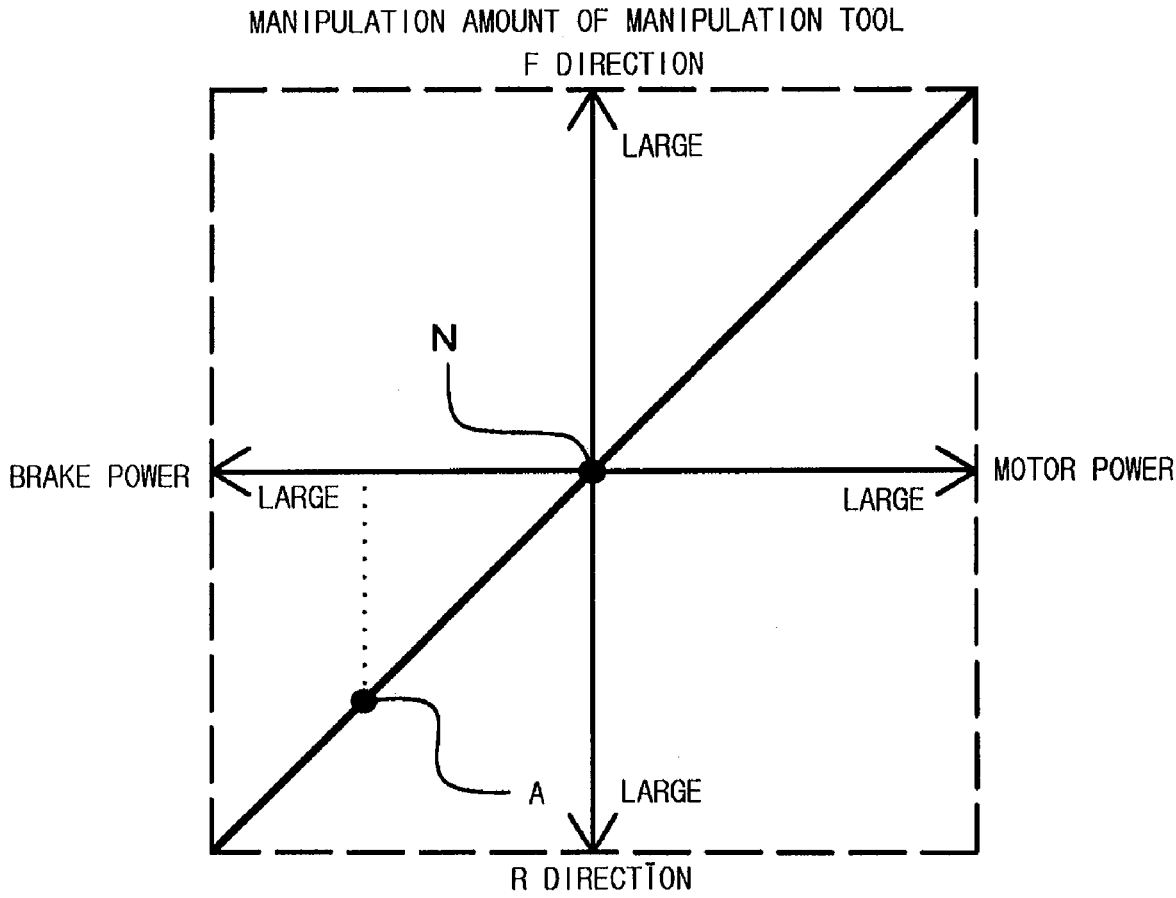
FIG. 3 is a view illustrating the manipulation amount of a manipulation tool with respect to the output power and brake power of a motor installed in a control target when the manipulation tool is allocated for forward and brake modes.

FIG. 3 is a view illustrating the manipulation amount of a manipulation tool with respect to the output power and brake power of a motor 12 installed in a control target when the manipulation tool is allocated for forward and brake modes. In FIG. 3, the brake power is that for braking a forward movement of the control target.

Figure 4:
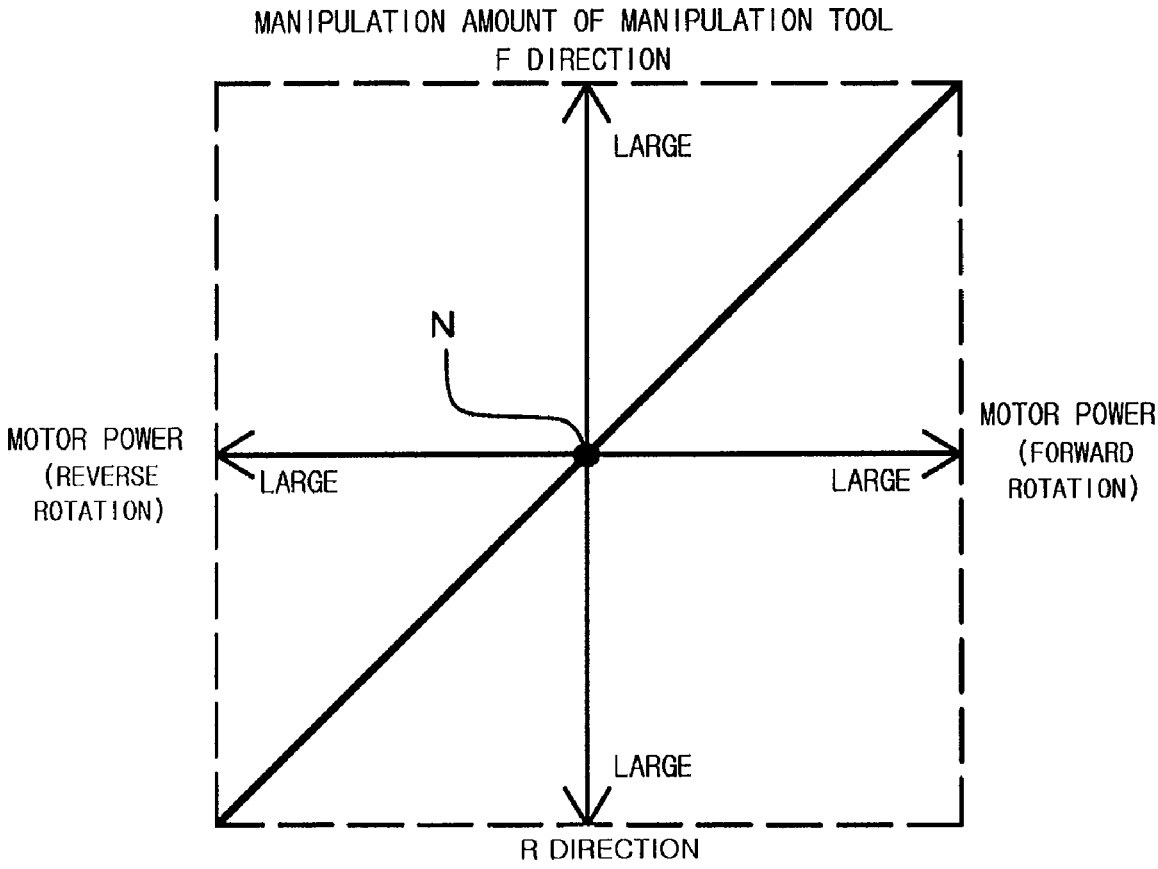
FIG. 4 is a view illustrating the manipulation amount of the manipulation tool with respect to the output power of the motor installed in the control target when the manipulation tool is allocated for forward and reverse modes.
Figure 5:
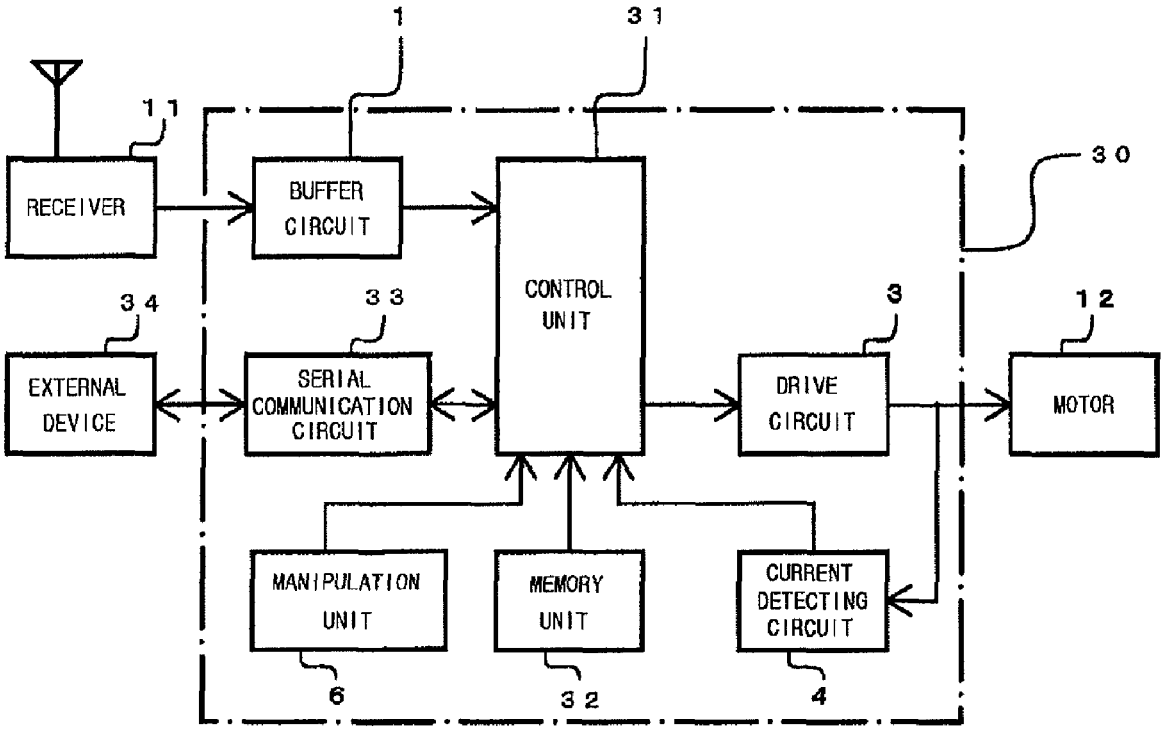
Prior Art Fig. 5
FIG. 5 is a block diagram illustrating a conventional motor controller for radio control.

FIG. 4 is a view illustrating the manipulation amount of the manipulation tool with respect to the output power of the motor 12 installed in the control target when the manipulation tool is allocated for forward and reverse modes.

The manipulation tool of FIGS. 3 and 4 may be a stick lever that can be manipulated in two directions (F and R directions) from a neutral point N. At the neutral point, the motor controller 10 is not in any mode.

The motor controller 10 includes a changeover unit for changing the manipulation state (mode). The changeover unit includes a control unit 2 configured to control mode changing operations, a memory unit 5 configured to store a specific value of a brake power contained in a signal demodulated by a receiver 11 as a changeover reference value A for switching from a brake mode to a reverse mode, a serial communication circuit 7 used as a setup unit for setting the changeover reference value A, and a changeover determining unit 8 configured to compare the brake power included in the demodulated signal with the changeover reference value A.

As shown in FIG. 3, if the manipulation tool is manipulated from the neutral point N in the F direction, the motor 12 is rotated forward, and the control target is moved forward. In addition, according to the manipulation amount of the manipulation tool, the rotation speed of the motor 12 is controlled, and the speed of the forward-moving control target is controlled.

If the manipulation tool is manipulated from the neutral point N in the R direction, the control target is braked, and the brake power is controlled according to the manipulation amount of the manipulation tool. At this time, the brake power included in the demodulated signal is also varied, and the brake power and the changeover reference value A are input to the changeover determining unit 8 through the control unit 2. The changeover determining unit 8 compares the brake power included in the demodulated signal output from the receiver 11 and the changeover reference value A, and if the brake power is equal to or higher than the changeover reference value A, the changeover determining unit 8 outputs a mode changeover signal to the control unit 2. If the manipulation tool is manipulated to the neutral point N after the mode changeover signal is transmitted to the control unit 2, the control unit 2 performs a mode changing operation so that the mode for a manipulation of the manipulation tool in the R direction is changed from the brake mode to the reverse mode.

If the manipulation tool is manipulated in the R direction after the mode is changed to the reverse mode, as shown in FIG. 4, the motor 12 is rotated in the reverse direction, and the control target is moved in reverse. In addition, according to the manipulation amount of the manipulation tool, the rotation speed of the motor 12 is controlled, and the speed of the reverse-moving control target is controlled. In the reverse mode, if the manipulation tool is manipulated from the neutral point N in the F direction, the control unit 2 performs a mode changing operation so that the mode for the manipulation of the manipulation tool in the R direction is changed from the reverse mode to the brake mode.

In addition, an operator can change the changeover reference value A by reading a new changeover reference value A from an external device 13 such as a computer through the serial communication circuit 7 used as a setup unit and storing the new changeover reference value A in the memory unit 5.

Figure 2:
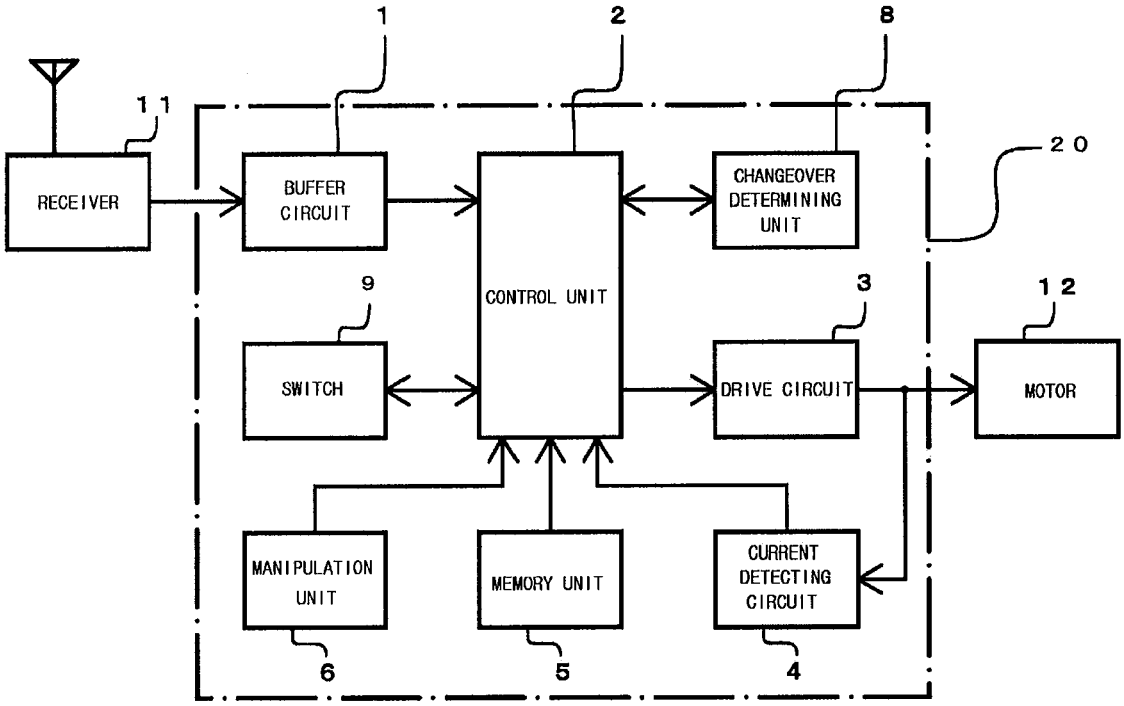
FIG. 2 is a block diagram illustrating a motor controller for radio control in accordance with another embodiment of the present invention.

Another embodiment of the present invention will now be described with reference to FIG. 2. Referring to FIG. 2, as a setup unit for changing the changeover reference value A, a switch 9 such as a volume switch is installed in a motor controller 20. In a state for changing various set values, a changeover reference value A set by the switch 9 is stored in a memory unit 5 through a control unit 2.

Thereafter, like the case of the motor controller 10 illustrated in FIG. 1, when a manipulation tool such as a stick lever is manipulated, forward-moving, braking, or reverse-moving of a control target is allowed according to the manipulation direction of the manipulation tool. In addition, a changeover between a brake mode and a reverse mode is similarly performed by manipulating the manipulation tool.

Three manipulation states are explained in the above-described examples; however, in a way of setting a reverse brake mode as a fourth manipulation state for braking a reverse movement of the control target, four modes can be set according to manipulations of the manipulation tool.

In the above-described embodiments, when an operator wants to manipulate the brake finely, the operator can set the changeover reference value to a high value. In this case, since the mode is not changed by a low brake power, a fine brake manipulation is possible. On the other hand, when the operator does not want to manipulate the brake finely, the operator can set the changeover reference value to a low value. In this case, a mode changeover can be readily performed.

In the embodiment illustrated in FIG. 1, the external device can be used to set a changeover reference value, and in this case, the number of components of the motor controller can be reduced.

Besides, in the embodiment illustrated in FIG. 2, a switch such a volume switch or a dip switch is installed in the motor controller for setting a changeover reference value so that a changeover reference value can be set using the motor controller without having to use an additional device.

According to the present invention, in the above-described motor controller for radio control, when the brake power is lower than the changeover reference value, the brake mode is maintained, and when the brake power is equal to or higher than the changeover reference value, the brake mode can be changed to the reverse mode by manipulating the manipulation tool to the neutral point. In addition, the changeover reference value can be set by an operator.

What is claimed is:

1. A motor controller for radio control, the motor controller being installed in a control target to be remotely controlled so as to control forward-moving, reverse-moving, and braking of the control target by controlling a rotation direction and a rotation speed of a motor installed in the control target based on a signal demodulated, by a receiver, from a control-data signal transmitted from a transmitter to the receiver in response to a manipulation amount of a manipulation tool of the transmitter, the manipulation tool being configured to be manipulated in at least two directions from a neutral point such that when the manipulation tool is manipulated in one direction, the control target is moved forward, and when the manipulation tool is manipulated in the other direction, the control target is braked or moved in reverse, the motor controller comprising a changeover unit configured to change a manipulation state of the manipulation tool from a brake mode to a reverse mode, wherein the changeover unit comprises:

a memory unit configured to store a specific value of a brake power contained in the signal demodulated by the receiver as a changeover reference value for changing the manipulation state of the manipulation tool from the brake mode to the reverse mode;

a setup unit configured to change the changeover reference value;

a changeover determining unit configured to compare the brake power with the changeover reference value so as to output a changeover signal when the brake power is equal to or higher than the changeover reference value; and a control unit configured to change the manipulation state of the manipulation tool from the brake mode to the reverse mode when the manipulation tool is manipulated to the neutral point after the control unit receives the changeover signal.

2. The motor controller of claim 1, wherein the setup unit comprises a serial communication circuit connected to an external device for reading a changeover reference value set at the external device and replacing the changeover reference value stored in the memory unit with the read changeover reference value.

3. The motor controller of claim 1, wherein the setup unit comprises a switch installed at the motor controller for reading a changeover reference value set by the switch and replacing the changeover reference value stored in the memory unit with the read changeover reference value.

* * * * *